United States Patent [19]

Mathieu

[11] 4,149,509

[45] Apr. 17, 1979

[54] BREAKERLESS IGNITION SYSTEM

[76] Inventor: Joseph P. Mathieu, 95 Lowell Ave., Sierra Madre, Calif. 91024

[21] Appl. No.: 851,118

[22] Filed: Nov. 14, 1977

[51] Int. Cl.[2] ..... F02P 3/06

[52] U.S. Cl. ..... 123/148 CC; 361/257

[58] Field of Search ..... 123/148 CC, 148 NC, 123/148 F, 148 CB; 320/1; 361/257

[56] References Cited

U.S. PATENT DOCUMENTS

| | | | |
|---|---|---|---|
| 3,490,426 | 1/1970 | Farr | 123/148 CC |
| 3,704,701 | 12/1972 | Struber et al. | 123/148 CC |
| 3,943,905 | 3/1976 | Hartig | 123/148 CC |

*Primary Examiner*—Stuart N. Hecker

*Attorney, Agent, or Firm*—Robert K. Wallor

[57] ABSTRACT

An ignition system for internal combustion engines, primarily as utilized in motorcycle type vehicles, is disclosed wherein the conventional breaker points and associated circuitry are eliminated and in their stead is incorporated a capacitive discharge circuit consisting of a step-up transformer for charging the capacitor, from a low voltage magneto, triggering circuitry to provide controlled discharge of the capacitor through the ignition transformer, and associated circuit protective components. The several components are configured in a manner such that neither the standard low voltage magneto nor the standard ignition transformer need be of special design or manufacture.

2 Claims, 1 Drawing Figure

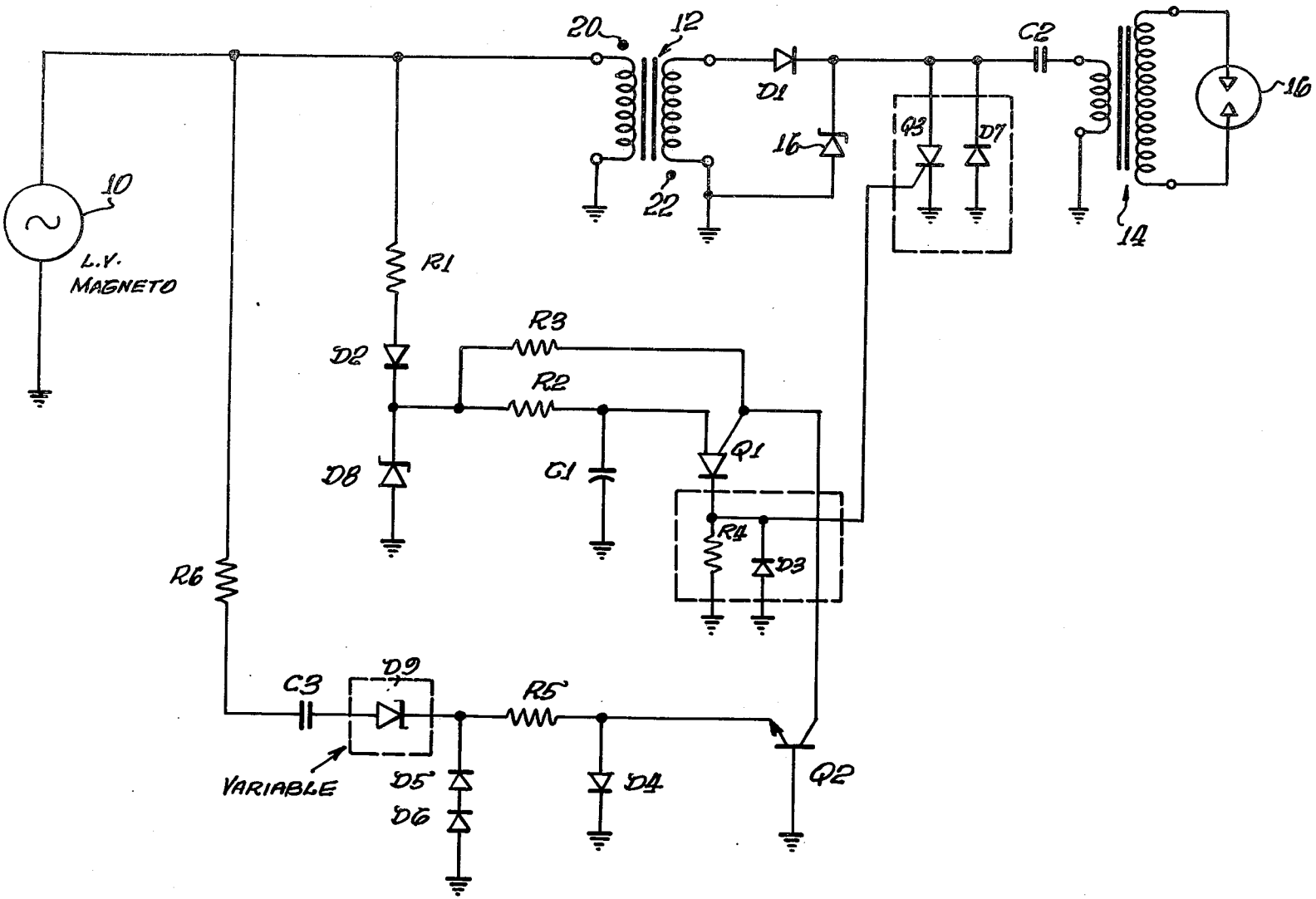
16
14
C2
D7
Q3
D1
18
12
22
20
Q1
D3
R4
Q2
D4
R3
R2
C1
R5
R1
D2
D8
D9
D5
D6
C3
VARIABLE
R6
10
L.V.
MAGNETO

BREAKERLESS IGNITION SYSTEM

BACKGROUND OF THE INVENTION

All internal combustion engines, except those operating under Diesel cycle principles, require an ignition spark to initiate the combustion of the compressed fuel-/air mixture. Several methods of generating said ignition spark are presently well understood. They all rely upon the rapid imposition of a high voltage, of the order of ten or twenty kilovolts, across the gap of a "spark plug," which is caused to arc across said gap producing a spark. These systems differ in the manner in which the high voltage is supplied to the spark plug, the means utilized to produce the high voltage, and in the primary source of the electrical energy.

For convenience in relating the several methods currently in use with the invention disclosed herein, the primary source of electrical energy will be limited to magneto devices, such as are typically used in motorcycles and similar applications.

The most common approach presently in use, in its simplest form, employs a set of mechanically actuated breaker points and a capacitor configured in a parallel circuit with a low voltage output magneto, and that group in parallel circuit with the primary winding of a standard ignition transformer. The secondary winding of the ignition transformer bridges the gap of the spark plug. The breaker points are abruptly opened, by the mechanical action of a cam, at or near the peak of the magneto output, thereby generating a voltage pulse of approximately 100 to 200 volts across the primary winding of the ignition transformer. This voltage is transformed into the required high voltage which appears across the secondary winding of the ignition transformer.

Such systems require frequent maintenance because of the severe arcing across the breaker points during the opening process. A capacitor is used to suppress much of the arcing, but the problem remains. Additionally, the cam surfaces wear rapidly and require lubrication. The performance of these systems suffers at high speeds due to the mechanical inertia of the breaker point assembly causing erratic timing. Moreover, the time available to build substantial energy in the magneto transformer is inversely proportional to the engine speed.

In order to overcome the disadvantages found in "breaker" type ignition systems, several "breakerless" techniques have subsequently been disclosed. These systems, often called "electronic ignition" or "capacitive discharge ignition" systems, all employ a capacitor wherein electrical energy is caused to be stored until it is rapidly discharged through the primary winding of the ignition transformer. Several alternate triggering techniques have been suggested but in operation they appear to be similar in that they rely upon either peak detection of the magneto output voltage or zero-crossing in the rate of change of magneto output voltage to provide a gate signal to a silicon-controlled rectifier or a similar device which then becomes conductive thereby allowing the capacitor to rapidly discharge.

Due to the characteristics of such capacitive discharge systems as are presently within the knowledge of the inventor herein, the primary energy source, typically a magneto, must produce a voltage output significantly higher than that required of a breaker type ignition system. This results in the necessity to produce specially wound magnetos having either a larger number of turns in the windings or extremely large and strong magnets, or some combination of the two. Such special magnetos, which will provide the higher voltages required to charge the capacitor, significantly increase the cost, weight, and volume of the ignition system.

SUMMARY OF THE INVENTION

The present invention, disclosed herein, offers several improvements over the prior art that has come within the inventor's knowledge. The use of a standard low voltage magneto as the primary energy source, the output of which is transformed by an out-of-phase step-up transformer into the high voltage capacitor charging voltage, and the use of peak detecting the magneto output to trigger the capacitor discharge at the reverse phase, provide means to economically increase the charging time period, and to permit electronic spark advance or retardation, through the use of a variable threshold, thereby allowing a more efficient engine operation over a wide range of engine speeds. Additionally, as with all breakerless ignition sytems, the absence of mechanically operating parts, removes the need for frequent maintenance.

The foregoing and other objectives and advantages of the present invention will appear from the following detailed description, taken with the accompanying drawings of the preferred embodiments.

BRIEF DESCRIPTION OF THE DRAWING

FIG. 1 presents an overall circuit schematic diagram of the preferred circuit for the breakerless ignition system.

DESCRIPTION OF THE PREFERRED EMBODIMENT

The breakerless ignition system of the present invention, as illustrated schematically by FIG. 1, is comprised of a standard low voltage magneto, 10, electrically connected parallel circuits to the primary winding of a step-up transformer 12, a trigger pulse generating network consisting of components R1, R2, R3, R4, C1, D2, D3, D8, and Q1, and a peak detecting network consisting of components R5, R6, C3, D4, O5, D6, D9, and Q2. The output from the secondary winding of the step-up transformer 12 is electrically connected by parallel circuits to the charging and discharging network, D1, D7, and Q3, and to the charge storage capacitor C2 which is in series electrical connection with the primary winding of a standard ignition transformer 14. A zener diode 16 may be utilized to preclude false triggering. The high voltage output of the secondary winding of the standard ignition transformer 14 is placed directly across the gap of a standard spark plug 18 where it creates the necessary ignition spark.

Within said trigger pulse generating network, resistor R1 is electrically connected in series with diode D2 and the parallel combination of (a) resistor R3, which in turn is connected to both the bias point of the unijunction transistor Q1 and to the collector of transistor Q2 (within the peak detecting network), (b) resistor R2, which in turn is connected to the parallel combination of capacitor C1 to ground and base of the unijunction transistor Q1, and (c) zener diode D8 to ground. The output of the unijunction transistor Q1 is directed to the parallel combination of resistor R4 to ground diode D3 to ground, and the gate of SCR Q3 (within the charging and discharging network).

Within said peak detecting network, resistor R6 is connected in series with capacitor C3, the variable zener diode D9, and the parallel combination of (a) the series of diode D5 and diode D6 to ground, and (b) the series of resistor R5 and the parallel combination of diode D4 to ground and the emitter of transistor Q2. The base of transistor Q2 is at ground.

Within said charging and discharging network, at the output from the secondary winding of the step-up transformer 12, one end of said winding is at ground while the other is connected in series with diode D1 and the parallel combination of (a) the silicon-controlled rectifier SCR Q3 to ground, (b) diode D7 to ground, and (c) the charge storage capacitor C2. The false triggering inhibiting zener diode 16, if present, is connected from the grounded end of the secondary winding of the step-up transformer 12 to the aforementioned parallel combination.

Considering, in more detail, the schematic of FIG. 1, the low voltage magneto, through electromagnetic induction produced by its mechanical motion, creates a cyclically time varying, low voltage signal which is fed through the primary winding of the step-up transformer 12. Said transformer 12 increases the voltage level at the output of its secondary winding such that the firing capacitor C2 is charged through diode D1 and the primary winding of the ignition transformer 14. The phasing dots 20, 22, shown in FIG. 1, indicate that the charging voltage is applied during the half cycle preceding the desired firing cycle.

Resistors R1, R2, R3, R4, capacitor C1, diodes D2, D3, D8, and the programmable unijunction transistor Q1 form the ignition fire trigger pulse generating network. During the magneto half-cycle utilized for charging the firing capacitor C2, this network is essentially non-operative through the signal blocking actions of the several diodes. During the firing half-cycle, the several circuit components perform as follows. Diode D8 limits the voltage delivered to the trigger circuit to safe levels even under high engine speed conditions. Resistor R1 is a current limiting resistor for the entire trigger circuit. Diode D2 prevents capacitor C1 from discharging through resistor R2 while the magneto voltage output is less than the charge impressed on capacitor C1. Resistor R3 keeps the programmable unijunction transistor Q1 biased to its off state unless transistor Q2, in the peak detector circuit, is conducting. Resistor R4 provides a conduction path for transistor Q1 and also helps keep the SCR Q3, discussed below, from conducting in an erratic manner. Diode D3 protects transitor Q1 from conduction transients created by operation of the SCR Q3. Resistor R2 acts as an additional current limiting device for transistor Q1 during conduction by Q1 and it also then fixes a continuous bias upon SCR Q3, thereby extending the SCR Q3 conduction time while the magneto voltage level is sufficiently high.

The programmable unijunction transistor Q1 is caused to conduct by lowering the voltage at the junction of resistor R3 and the collector of transistor Q2. This gate level causes the device to switch on and remain conducting until either the supply voltage or the trigger voltage is removed. The abrupt gating of this device, caused by arrival of the trigger voltage from the peak detector circuit via transistor Q2, causes capacitor C1 to discharge through the parallel combination of resistor R4 and the gate of the silicon-controlled rectifier Q3. This large pulse current is necessary to assure positive gating of SCR Q3. Once SCR Q3 is activated, the sustaining current provided through resistor R2 is sufficient to keep SCR Q3 in its conducting state.

The combination of the silicon-controlled rectifier Q3 and diode D7 form the firing capacitor discharging circuits for the firing capacitor C2. Diode D7 is a free wheeling diode included in the circuit to enhance the discharge of capacitor C2. The degree of discharge of capacitor C2, and hence the energy transferred to the ignition transformer, is a function of the duration of the conduction period for the SCR Q3/diode D7 combination. The bias voltage and sustaining current discussed above provide the desirable extended time period. The silicon-controlled rectifier Q3 is caused to switch to the conducting state by the arrival of the trigger pulse as heretofore discussed.

The initiation of the trigger pulse is controlled by the gating to the conducting state of the programmable unijunction transistor Q1. This gating is provided by a signal generated when transistor Q2 in the peak detector circuit achieves its conducting state. The operation of said peak detector circuit commences with the charging of capacitor C3 through the current limiting resistor R6 to the voltage level established by the circuitry of diodes D4, D5, and D6 in combination with resistor R5 and with the variable zener diode D9. Diode D4 protects the emitter-base junction of transistor Q2 from damage and faulty operation. At the peak output of the magneto 10, capacitor C3 is charged and diode D4 ceases to conduct. As the magneto voltage begins to drop, virtually no current will flow in the capacitor C3 charging circuit until the magneto voltage falls to a level below the charge on capacitor C3 by an amount equal to the zener diode voltage of diode D9 in combination with diodes D4 and D6. When this state occurs, diodes D5 and D6, through resistor R5, act with transistor Q2 to form a current source for triggering the programmable unijunction transistor Q1, said triggering signal lasting until the combination of the magneto drive voltage and the discharging capacitor C3 can no longer keep transistor Q2 in conduction.

It can be observed from the foregoing description that the circuitry described, and depicted in FIG. 1, operates and performs uniformly over a borad range of magneto speeds, governed only by the time constants associated with the charging of capacitors C1, C2, and C3.

While other circuitry may be devised to replace portions of the depicted schematic circuit of FIG. 1, none appear that provide the degree of circuit protection from excess voltages arising at the magneto, the extended pulse, width, or the fast, clean ignition triggering afforded by this circuitry.

Whatever may be the modification or a varied embodiment of the concepts herein claimed, the purpose remains to provide a breakerless ignition system wherein the standard low voltage magneto and the standard ignition transformer are not subjected to costly modification and wherein the magneto output is increased in voltage level and delivered to the standard spark plug in a timely manner to provide engine efficiency over a broad range of engine speeds. The additional circuitry required for multiple spark plug firing and control is not within the scope of this disclosure since it impacts only the wave form produced by the magneto or other primary power source and in the distribution of the output of the ignition transformer to the multiplicity of spark plugs.

I claim:

1. A breakerless ignition system comprises of a low voltage magneto device, a capacitor charging circuit, an ignition firing-pulse generating circuit, a peak-detecting timing circuit, and a standard ignition transformer and spark plug combination connected electrically such that the low voltage output wave form of the magneto device is used to charge an ignition firing capacitor during the half-cycle periods not intended for engine ignition, said charging to be accomplished by elevating the low voltage output of the magneto device by step-up voltage transformer means through protective circuitry components, said charged ignition firing capacitor being discharged during the appropriate half-cycle periods by electrically triggering an electronic switching device within the charging circuitry to a conducting state thereby providing a circuit path for the passage of the stored energy from the firing capacitor through the ignition transformer resulting in arcing across the spark plug gap, said electrical triggering signal results from the release of capacatively stored energy, developed in a parallel circuit path from the low voltage magneto device's output, said release of the triggering signal being controlled by a second electronic switching device which is gated to a conducing state by a signal originating in said peak detecting timing circuit which forms an additional parallel circuit emanating from the output of the low voltage magneto device; all of said circuits containing electronic components of appropriate type and value to perform their necessary signal generation and circuit protection functions.

2. The breakerless ignition system of claim 1, wherein a zener diode is employed across the secondary winding of the step-up transformer means including its blocking diode, to inhibit false triggering.

* * * * *